US005343564A

United States Patent [19]

Reynolds et al.

[11] Patent Number: 5,343,564

[45] Date of Patent: Sep. 6, 1994

[54] PROTECTIVE BODY UNDERGARMENT

[76] Inventors: Craig S. Reynolds, 8122 G. Brown Ct., Tinker AFB, Okla. 73145; William W. Harris, 1533 Midwest Blvd., Apt. 5, Midwest City, Okla. 73110

[21] Appl. No.: 91,285

[22] Filed: Jul. 15, 1993

[51] Int. Cl.[5] ..... A41D 13/00

[52] U.S. Cl. ..... 2/70; 2/236

[58] Field of Search ..... 2/70, 69, 79, 80, DIG. 6, 2/239, 269, 236, 4, 127, 60, 234, 239, 90, 409

[56] References Cited

U.S. PATENT DOCUMENTS

| | | | |
|---|---|---|---|
| 1,833,163 | 11/1931 | Ischinger | 2/239 |
| 3,488,776 | 1/1970 | Luhr | 2/90 |
| 3,496,572 | 2/1970 | Herzig . | |
| 3,994,026 | 11/1976 | Sampey | 2/79 |
| 4,601,066 | 7/1986 | Campbell . | |
| 4,685,152 | 8/1987 | Heare . | |
| 4,914,756 | 4/1990 | Grassick | 2/DIG. 6 |
| 4,932,078 | 6/1990 | Jones et al. . | |
| 5,091,993 | 3/1992 | Merrill et al. | 2/4 |
| 5,097,537 | 3/1992 | Ewing | 2/409 |
| 5,119,510 | 6/1992 | Schilling | 2/4 |
| 5,182,812 | 2/1993 | Goldsby | 2/79 |
| 5,214,797 | 6/1993 | Tisdale | 2/4 |

FOREIGN PATENT DOCUMENTS

| | | | |
|---|---|---|---|
| WO10074 | 12/1988 | European Pat. Off. | 2/69 |
| 375131 | 6/1932 | United Kingdom | 2/239 |

*Primary Examiner*—Clifford D. Crowder
*Assistant Examiner*—Gloria Hale
*Attorney, Agent, or Firm*—Dougherty, Hessin, Beavers & Gilbert

[57] ABSTRACT

An insect-proof, form-fitting undergarment consisting of top and bottom parts formed of selected breathable material and having omnidirectional stretch properties, and which top and bottom parts may be securely joined at the waist to prevent insect entry. A light cotton lining may be utilized in either or both of said top and bottom parts.

4 Claims, 2 Drawing Sheets

PROTECTIVE BODY UNDERGARMENT

BACKGROUND OF THE INVENTION

1. Field of the Invention

The invention relates generally to protective garments and, more particularly, but not by way of limitation, it relates to an improved form of undergarment that provides nearly total body shielding from crawling insects and the like such as might be encountered in thickly wooded and/or tropical climate conditions.

2. Description of the Prior Art

The prior art includes a great number of protective garment teachings or particular combinations of protective features which have been developed over a long period of years. One example of an insect protective garment is U.S. Pat. No. 4,685,152 which teaches a heavy, tightly sealed outer garment intended for insect protection, and this type of protective garment also includes absolute protection about the head and face as it includes an isolating visor and head closure member. This device is an outer garment wherein tightness of closure is a prime feature. U.S. Pat. No. 3,496,572 provides teaching of another form of outer garment that provides tight closure in protection of the human body. In this case, the suit is intended for dust-proof maintenance of the wearer. This patent too is directed to a very bulky outer garment with a plurality of straps and cinches about selected body areas and including a visor and full head protector. Wrist and ankle security is further protected by multiple wraps of isolation material.

U.S. Pat. No. 4,601,066 teaches a more form-fitting type of outer garment of the type that is intended for use by dancers, gymnasts and acrobats. Here again, the wrists and ankles are wrapped with multiple folds in order to provide warming at the extremities and neck of the wearer.

SUMMARY OF THE INVENTION

The present invention relates to an improved type of protective undergarment which has the quality of being extremely light in weight while still having the capability of protecting against insect bites and entry of foreign matter in general. The garment consists of form-fitting top and bottom sections with VELCRO® hook and loop fastener or other joinder means providing secure closure between the top and bottom garment members. The top and bottom garment members all include lightweight, tight-fitting cuffs at the extremity positions. Thus, the top member includes wrist cuffs, waist cuff and high neck cuff while the bottom member includes a waist cuff and ankle cuffs. The undergarment is constructed from a selected, thin synthetic material that breathes freely and has omnidirectional stretch. Reinforcement plies may be included at the knees and elbows and a cotton material inner liner may be included in order to gain advantage of certain comfort aspects. Means is provided for preventing separation of the top garment member waist portion and the bottom garment member waist portion in order to provide what is effectively a lightweight, form-fitting, one-piece body cover for protection against vermin and discomforting particulate matter.

Therefore, it is an object of the present invention to provide a very lightweight body suit for protective use by sportsmen, military and the like during outdoor activity.

It is still further an object of the present invention to provide a form-fitting two-piece body suit that provides insect protection in the field without imposing undue discomfort or interference with movement.

Finally, it is an object of the present invention to provide a form-fitting undergarment that may include attributes of both insect protection and warmth.

Other objects and advantages of the invention will be evident from the following detailed description when read in conjunction with the accompanying drawings which illustrate the invention.

DETAILED DESCRIPTION OF THE INVENTION

Figure 1:
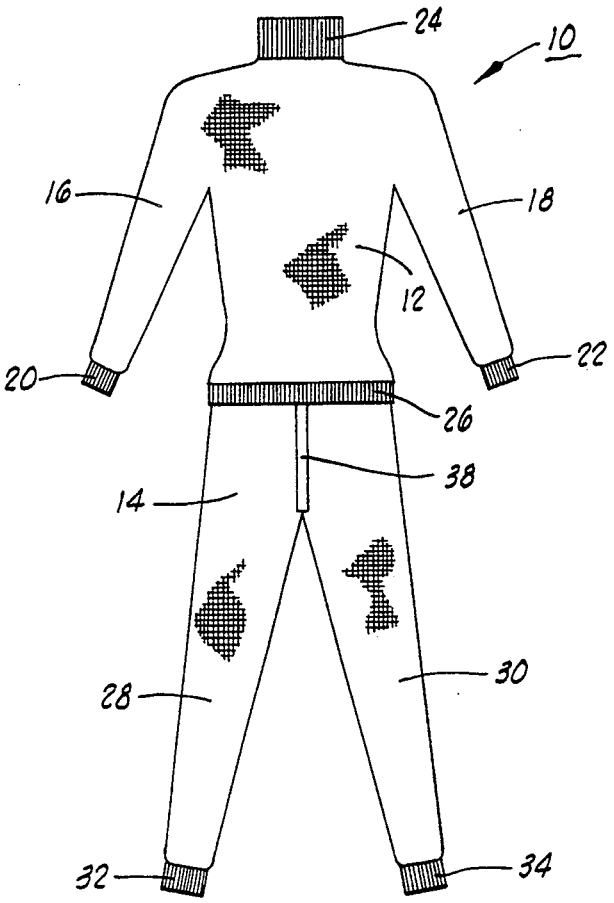
FIG. 1 is a view in elevation of the full undergarment.

Referring to FIG. 1, an undergarment 10 consists of an upper part 12 and a bottom pants part 14, each of which are formed from a selected synthetic plastics material that has desirable attributes as to weight, stretch and closeness of weave. The top part 12 includes right and left arms 16 and 18 which terminate in respective knit cuffs 20 and 22. The form-fitting top part 12 also includes a high, turtle-type knit collar 24 and a below waist cuff 26. Each of the cuffs is suitably formed as by knitting to include sufficient elasticity to assure firm fitting without any discomfort. The arms 16 and 18 are tubularly seamed in conventional manner and joined to top part 12 by opposite diagonal shoulder seams.

It is desirable that the material of top part 12 be a selected material woven from low denier yarn which exhibits qualities of very lightweight and omnidirectional stretch so that a good, comfortable form-fit is achieved. Generally speaking, any of a number of nylon stretch materials may be used; however, practice has shown that a material known as Glistenette available from Minnetonka Mills, Inc. of Minneapolis, Minn., is quite good for the present use. This material consists of 90 percent ANTRON TM nylon and 10 percent LYCRA TM (Spandex) and it is formed in a spandex type weave to exhibit a weight of about 3.5 ounces per square yard. The material has stretch ability in all directions and a close but not yet totally opaque weave. That is, there is sufficient pass-through space in the weave to permit free air circulation yet prevent the passage of insects, even minute insects such as the common chigger.

The bottom part 14 is formed from the same material to include form-fitting right and left legs 28 and 30 which terminate with respective knit ankle cuffs 32 and 34. The top part of lower part 14 terminates in a waist cuff 36 (as will be described in FIG. 2) which is tightly retained beneath outer waist cuff 26 for security purposes. The bottom pants part 14 also includes a front fly 38 which is suitably closed by means of either a zipper or a VELCRO® pile/hooks fabric combination, a hook and loop fastener. A snap on hook device (not shown) is fastened at the point of waist cuff joinder on the front fly 38. Conventional pant leg seaming may be employed and bottom part 14 is preferably formed with a diamond panel crotch inset to minimize the possibility of crotch seam splitting.

Figure 2:
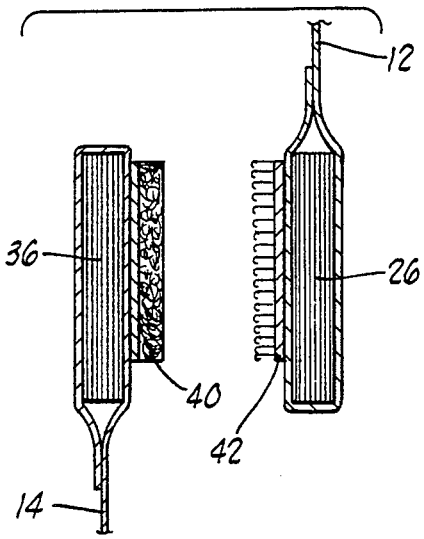
FIG. 2 is a view in section of a portion of waist band of the top and bottom garment members and showing a method of joinder.

FIG. 2 shows one form of fabric combination for securing the top and bottom parts 12 and 14. The outer waist cuff 36 of bottom part 14 may include a VELCRO® hook and loop fastener or pile strip 40 sewn completely around the inside of waist cuff 36. In like manner, a VELCRO® hook strip 42 is sewn completely around the outer side of knit cuff 26 of the upper part 12. When the upper and lower parts 12 and 14 are donned by the wearer, he can then place the outer knit waist cuff 26 in super-position over lower waist cuff 36 so that the pile strip 40 and hook strip 42 meshes around the circumfery thereby to effect an insect-tight joinder of the top and bottom undergarment pieces.

Figure 3:
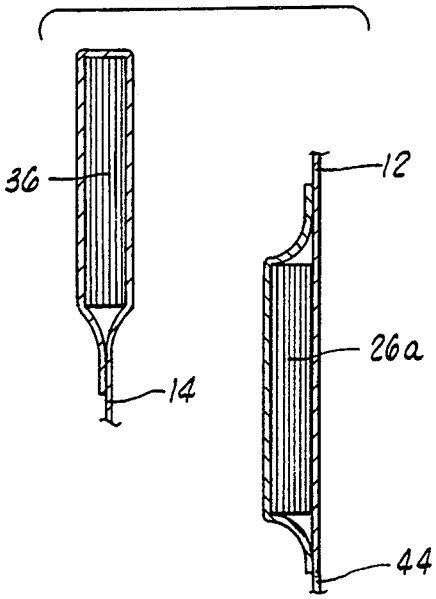
FIG. 3 is a view in section of the waist band for top and bottom garment members and showing an alternative form of joinder.

Alternative securing structure for joining the top part 12 to bottom part 14 is shown in FIG. 3. Thus, the top part 12 may include a slightly lower waist cuff **26*a* which, when tucked in, provides an interlocking relationship to the waist cuff 36. In addition, the top part 12 is formed to extend additional shirttail material 44 beneath waist cuff 26*a* to assure further that no break occurs between top part 12 and bottom part 14** during extended activity.

Figure 4:
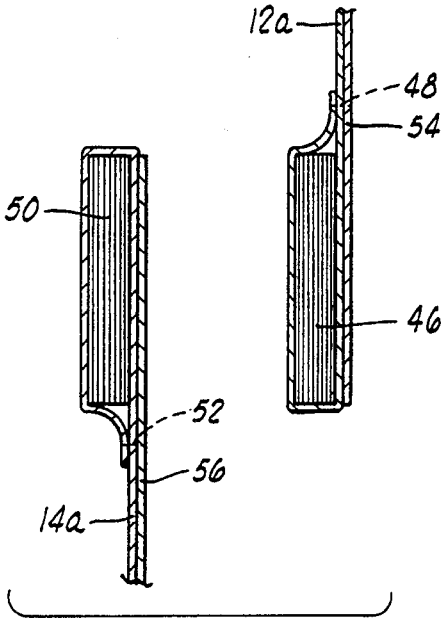
FIG. 4 is a view in section showing the selected portion of top and bottom members as they employ an alternative cotton liner feature.

FIG. 4 shows an alternative form of construction wherein the material of the upper part **12*a* and lower part 14*a* are simply stitched around their respective waist bands. That is, the upper part 12*a* material is folded totally around the waist cuff or elastic member 46 and secured by stitching 48. In like manner, the material of lower part 14*a* is folded around the waist cuff elastic member 50 and secured by stitching 52. Other security provisions such as those shown in FIGS. 2 and 3** may also be included in order to maintain integrity of insect-proof coverage.

Figure 5A:
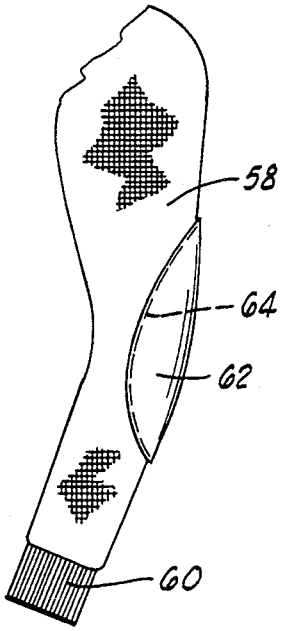
FIGS. 5*a* and 5*b* illustrate alternative forms of structure wherein reinforcement is applied at the elbow and knee garment coverage, respectively.
Figure 5B:
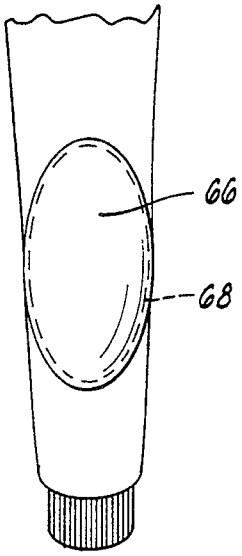

FIG. 4 also shows the inclusion, in both bottom and top parts **12*a* and 14*a*, of a thin cotton material liner 54 and 56, respectively. The upper cotton liner 54 and lower cotton liner 56 may be extended throughout the entire torso, leg and body portions for the purpose of providing greater comfort in certain conditions. The lining using very light cotton fabric could add considerable heat insulation quality while further assuring insect protection, and it would be particularly desirable in cooler weather. FIGS. 5A and 5B illustrate a method of reinforcement which also may be included. Thus, FIG. 5A shows an arm 58 with cuff 60 and also includes a reinforcing elbow ply 64 of material which is secured by stitching 64. More than one ply 62 may be included in the reinforcement panel if desired. As shown in FIG. 5B, similar reinforcement panels 66 and stitching 68** may be included in the lower parts of the undergarment for knee protection.

The foregoing discloses a novel form of undergarment that provides protection against discomforts that one may encounter during outdoor, field activity. The undergarment is a form-fitting, two-piece coverall that is constructed from very lightweight, elastic material, and it functions quite favorably for outdoor activities of such as the military, hunters, fishermen and other outdoor disposed activities.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A form-fitting insect-proof, protective undergarment, comprising:

an upper body form-fitting garment having a torso section and arm sections and being formed from a synthetic plastic woven material of 90 percent nylon and 10 percent spandex weighing about 3.5 ounces per square yard and having approximately equal stretch in any direction, and having an open weave allowing air passage but preventing small insect passage;

a first elastic cuff secured to define the neck opening of the torso section;

a second elastic cuff secured to define the waist band around the torso section;

a pair of third elastic cuffs disposed at the outer terminus of each of the arm sections;

a shirt tail extending from said upper garment torso section in extension below the second elastic cuff so that the second and fourth elastic cuffs interlock over said shirt tail;

a lower body, form-fitting garment having a waist section and left and right leg sections and being formed from said synthetic plastic woven material of 90 percent nylon and 10 percent spandex weighing about 3.5 ounces per square yard and having approximately equal stretch in any direction, and having an open weave that allows air passage but prevents small insect passage;

a fourth elastic cuff secured to define the waist band around the waist section;

a pair of fifth elastic cuffs disposed at the terminus of each of the left and right leg sections;

a fly flap disposed vertically in said waist section with hook and loop fastener means aligned therealong to effect closure; and hook and loop fastener means for securing the second elastic cuff and the fourth elastic cuff to secure the torso section waist band to the waist section waist band.

2. An undergarment as set forth in claim 1 wherein said hook and loop fastener means for securing comprises:

a first strip of hook fastener secured around the outer surface of the waist band around the torso section; and a second strip of loop fastener secured around the outer surface of the waist band around the waist section;

whereby the first and second strips may be joined together.

3. An undergarment as set forth in claim 1 which is further characterized to include:

cotton material of thin weight completely lining each of said upper body and lower body garments.

4. An undergarment as set forth in claim 1 which is further characterized to include:

reinforcing material added by stitching to the elbows of the upper garment part arm sections and the lower garment part leg sections.

* * * * *